United States Patent [19]

Anderson

[11] Patent Number: 4,846,972

[45] Date of Patent: Jul. 11, 1989

[54] SKIM NET ASSEMBLY FOR CLEANING SWIMMING POOLS AND THE LIKE

[75] Inventor: George F. Anderson, Mountaintop, Pa.

[73] Assignee: Muskin, Inc., Wilkis-Barre, Pa.

[21] Appl. No.: 170,175

[22] Filed: Mar. 18, 1988

[51] Int. Cl.[4] ..... E04H 3/20

[52] U.S. Cl. ..... 210/238; 210/470; 15/1.7; 15/144 R; 294/19.1; 43/12

[58] Field of Search ..... 210/169, 238, 470, 471; 209/417–419, 404; 15/1.7, 144 R, 144 A; 294/19.1, 55; 43/11, 12, 137

[56] References Cited

U.S. PATENT DOCUMENTS

| | | | |
|---|---|---|---|
| 1,716,697 | 6/1928 | Hunt | 15/144 R |
| 1,847,133 | 8/1930 | Nieman | 15/144 R |
| 2,583,987 | 1/1952 | Baisor | 43/12 |
| 3,188,668 | 6/1965 | Buckelew | 15/1.7 |
| 3,979,146 | 9/1976 | Berg | 15/1.7 |
| 4,003,100 | 1/1977 | Whitaker | 15/1.7 |
| 4,013,563 | 3/1977 | Petrik | 210/470 |
| 4,106,157 | 8/1978 | Baker | 210/470 |
| 4,152,801 | 5/1979 | Lieber | 210/169 |
| 4,198,720 | 4/1980 | Matsumoto | 15/1.7 |
| 4,225,437 | 9/1980 | Woodward | 15/1.7 |

*Primary Examiner*—Richard V. Fisher
*Assistant Examiner*—Coreen Y. Lee
*Attorney, Agent, or Firm*—Townsend and Townsend

[57] ABSTRACT

A skim net assembly having an open frame with a number of sides, and a web coupled to the frame at one of the sides. The net is secured in some suitable manner to the frame in alignment with the central opening through the frame so as to trap and collect debris as the skim net assembly moves in the water of debris-containing water in a forward or lateral direction. The cross section of three sides of the frame is blade-like in configuration; thus, the three sides permit a shovel-like action when cleaning a swimming pool which allows debris to be more effectively forced into the net when the assembly is being pushed over the bottom or moved laterally over the bottom surface of a swimming pool. A pole is coupled to the frame in a manner such that the pole is adjustably mounted on the frame for angular movement into any one of a number of operative positions. Thus, the present invention allows a side edge of the frame to be positioned so as to permit the side edge to move over the bottom of the pool for maximum debris collection.

8 Claims, 3 Drawing Sheets

FIG. 1
(PRIOR ART)
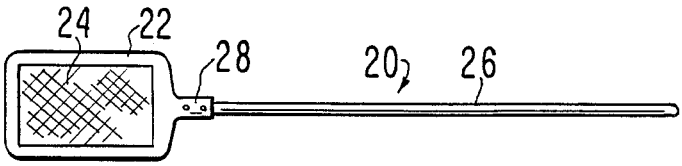
FIG. 2
(PRIOR ART)
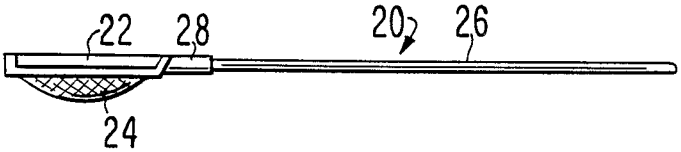
FIG. 3
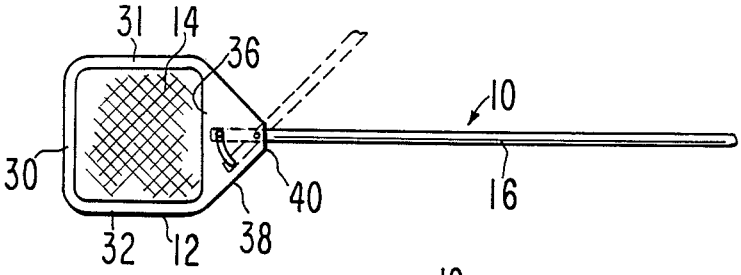
FIG. 4
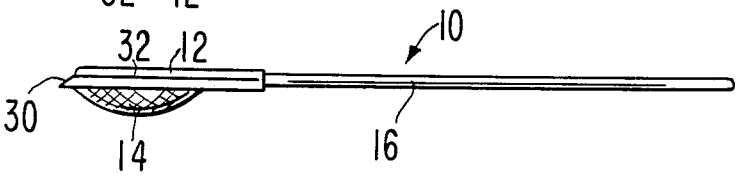
FIG. 5
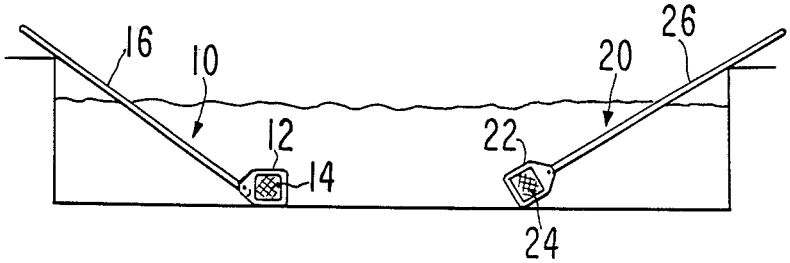
FIG. 6
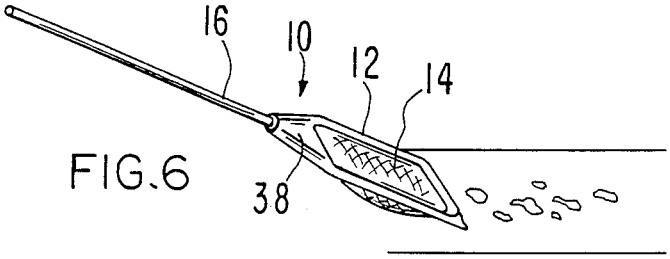
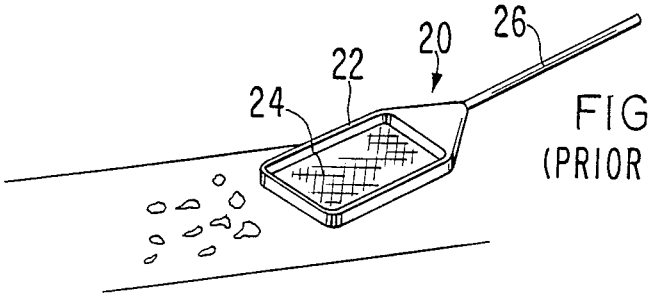
FIG. 7
(PRIOR ART)

FIG.9
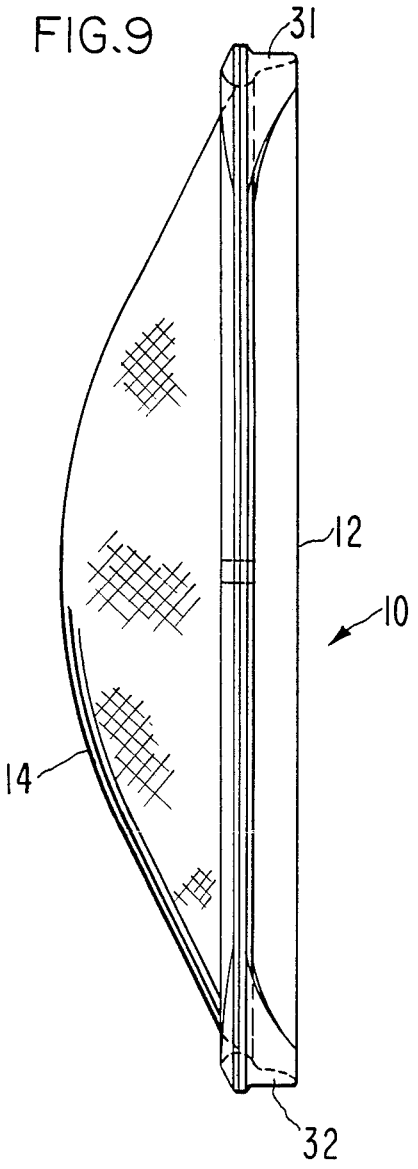
FIG.10
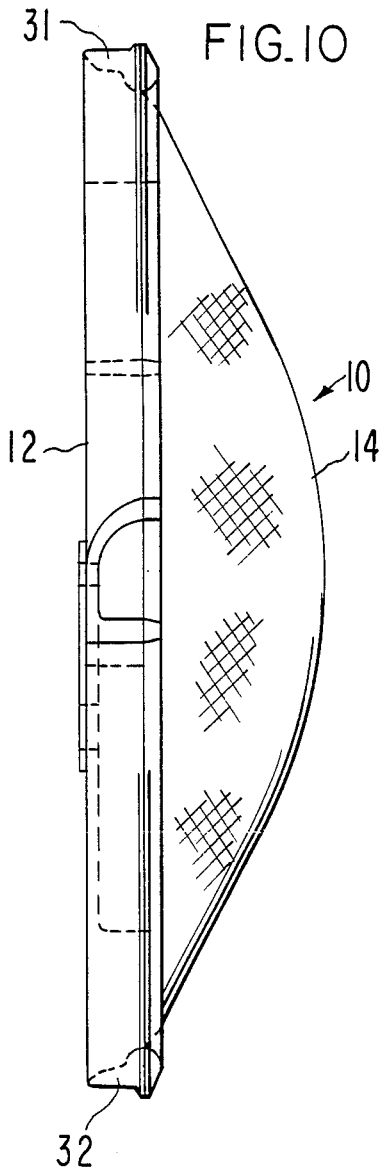
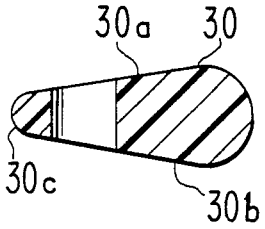
FIG.11
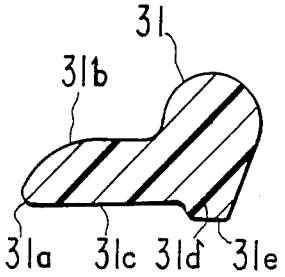
FIG.12

SKIM NET ASSEMBLY FOR CLEANING SWIMMING POOLS AND THE LIKE

BACKGROUND OF THE INVENTION

1. Field of the Invention

This invention relates to improvements in the cleaning of swimming pools, and more particularly, an improved skim net assembly for making the task of cleaning a swimming pool more efficient.

2. Description of the Prior Art

Skim nets for cleaning swimming pools and other bodies of water have been known and used in the past. Typically, a conventional skim net is constructed with a generally rectangular or square frame that has a net across an open central portion of the frame. An extension pole is rigidly secured at one end in some suitable manner to one side or one end of the frame. Thus, the sides of the skim net are effectively blunt and do not lend themselves to lazy collection or scooping of debris from a swimming pool, such as from the bottom surface of the swimming pool.

Since the pole is rigidly secured to the frame, no adjustment can be made between the two so as to permit a more effective cleaning of the bottom surface or side surfaces of a swimming pool. Thus, the skim nets of conventional construction are not effective in cleaning a maximum amount of debris from a swimming pool.

Because of these drawbacks of conventional skim nets, a need exists for improvements in skim nets to avoid the above problems. The present invention is directed to a skim net assembly which fulfills this need.

SUMMARY OF THE INVENTION

The skim net assembly of the present invention comprises an open frame having a number of sides, and a web coupled to the frame at one of the sides. The net is secured in some suitable manner to the frame in alignment with the central opening through the frame so as to trap and collect debris as the skim net assembly moves in the water of debris-containing water in a forward or lateral direction.

The cross section of three sides of the frame is blade-like in configuration; thus, the three sides permit a shovel-like action when cleaning a swimming pool which allows debris to be more effectively forced into the net when the assembly is being pushed over the bottom or moved laterally over the bottom surface of a swimming pool. This construction of the frame is to be contrasted to the frame members of conventional skim nets which have square cross sections and which present a blunt surface to the debris, preventing the debris from being completely drawn into the net.

Another aspect of the present invention is the provision of a pole coupled to the frame in a manner such that the pole is adjustably mounted on the frame for angular movement into any one of a number of operative positions. Thus, the present invention allows a side edge of the frame to be positioned so as to permit the side edge to move over the bottom of the pool for maximum debris collection yet the side can be provided with a blade-like cross section to cooperate with the angularity of the pole to enhance the debris collecting capability of the assembly of the present invention.

The primary object of the present invention is to provide an improved skim net assembly in which the assembly components are configured and coupled together in a manner to provide for a greater debris collection capability that is capable with skim nets of conventional design, all which can be achieved without increasing production costs and without requiring special talents on the part of a user of the assembly.

Other objects of this invention will become apparent as the following specification progresses, reference being had to the accompanying drawing for an illustration of the invention.

BRIEF DESCRIPTION OF THE DRAWINGS

FIGS. 1 and 2 are top plan and side elevational views of a typical skim net unit of the prior art;

FIGS. 3 and 4 are views similar to FIGS. 1 and 2 but showing in a somewhat schematic form the improved skim net assembly of the present invention;

FIG. 5 is a schematic view of a swimming pool, showing the way in which the improved skim net of FIGS. 3 and 4 is used in contrast to the use of the prior art skim net of FIGS. 1 and 2 to clean the bottom of a swimming pool;

FIG. 6 is a schematic view of the improved skim net of the present invention, showing the way in which it is used to shovel debris from the bottom of the swimming pool onto a net forming part of the skim net assembly of the present invention.

FIG. 7 is a view similar to FIG. 6 which shows a prior art skim net and illustrating the difficulty of sweeping or shoveling debris into the net of the skim net;

FIG. 9 is a end elevational view of one end of the skim net assembly of FIG. 8;

FIG. 10 is a view similar to FIG. 9 but showing an elevational view of the opposite end of the skim net assembly;

FIG. 11 is a cross-sectional view taken along line 11—11 of FIG. 8; and FIG. 12 is a cross-sectional view taken along line 12—12 of FIG. 8.

DETAILED DESCRIPTION OF THE PREFERRED EMBODIMENTS

Figure 8:
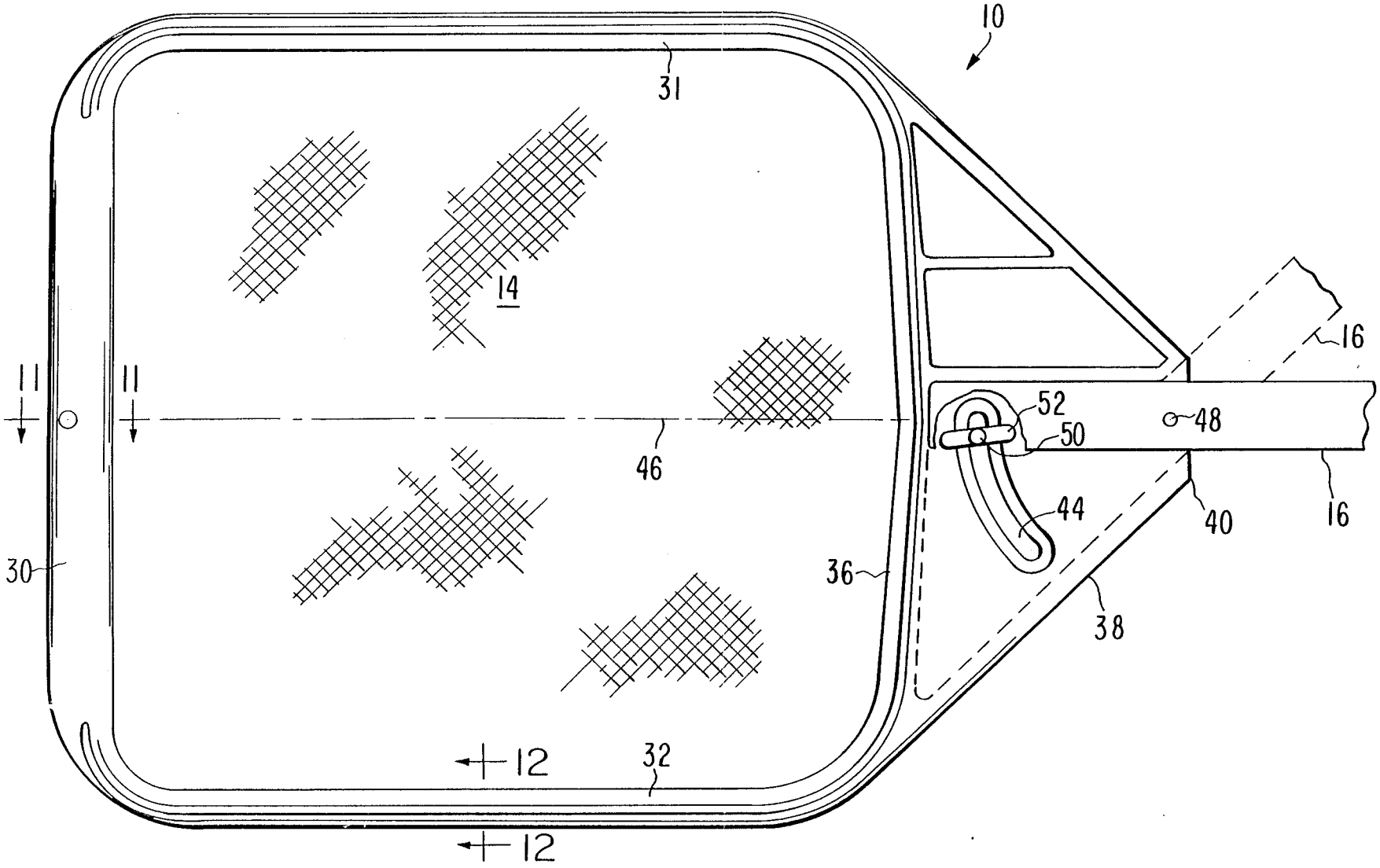
FIG. 8 is a top plan view of the skim net assembly of the present invention.

The skim net assembly of the present invention is broadly denoted by the numeral 10 and is shown schematically in FIGS. 3 and 4. Skim net assembly 10 is comprised of an open frame 12 for supporting a net 14, and an extension pole 16 is secured to a web 18 integral with frame 12 in a manner hereinafter described. Skim net assembly 10 is adapted for a number of uses including removing debris from the bottom of a swimming pool and for skimming debris from the top surface of the water in a swimming pool. Pole 16 is hand-held and manipulated to present net 14 to debris so as to sweep or urge the debris into the net, following which the debris is moved to a location remote from the pool where the net is emptied of the debris.

Skim net assembly 10 is to be contrasted with a prior art skim net unit 20 shown in schematic form in FIGS. 1 and 2. Skim net unit 20 includes a frame 22, a net 24 coupled in some suitable manner to the outer periphery of frame 22, and a pole 26 secured to a neck or collar 28 integral with a side member of the frame. The prior art skim net unit 20 has frame 22 rectangular or square. The cross section of the frame members of frame 22 is seen in FIG. 2 in which the cross section is generally rectangular so that the frame does not lend itself to maximum debris collection on the pool bottom or on the sides of the pool. In contrast with the frame shape of skim net unit 20, skim net assembly 10 of the present invention has a front edge 30 and a pair of spaced side edges 31 and 32 which are shaped in the form of a shovel or blade to permit easy entry of debris onto the net. Certain details of edges 30 and 32 will be discussed hereinafter.

Frame 18 includes a body 34 of which the three frame members or sides 30, 31 and 32 form a part. A fourth side 36 is integral at the ends thereof to the adjacent ends of sides 31 and 32 as shown in FIG. 8. A web 38 of triangular shape is integral with and extends away from side 36 to a location 40, web 38 being substantially in the plane of frame 34 and being the means by which the frame is coupled to one end of pole 16.

FIG. 11 shows the cross section of the frame at side 30 thereof. To this end, side 30 has a pair of surfaces 30*a* and 30*b* (FIG. 11) which converge toward and terminate near an outer end margin 30*c*. The surfaces 30*a* and 30*b* define a blade-like configuration for the side 30 and permit a shoveling action when the frame is manipulated by pole 16 in the manner shown in FIG. 6. By virtue of the construction of side 30, debris is more easily directed into the center of the frame and onto net 14 than is capable with the use of the prior art skim net unit 20 shown in FIGS. 1 and 2. The configuration of side 30 as shown in FIG. 11 continues substantially throughout the entire length of the side.

FIG. 12 shows a cross section of each of sides 31 and 32, each side having a pointed upper end margin 31*a* to which a pair of surfaces 31*b* and 31*c* converge from the lower end margin of the side 31 or 32. Pointed end margin 31*a* is typically at the upper edge of the frame as shown in FIGS. 9 and 10. The frame also has a heel 31*d* which has a flat outer side surface 31 which permits the end margin 31*a* to be slightly inclined when heel 31*d* is engaging the bottom surface of the pool as shown in FIG. 5. In this way, the shoveling action of side 31 or side 32 is greatly enhanced so that debris is more easily directed into the net 14 coupled with frame 18.

Web 38 has a curved slot 44 (FIG. 8) which is at one side of the center line 46 of the frame. In fact, one end of the slot 44 terminates near the center line of the frame. Pole 16 is pivotally mounted intermediate its ends by pivot pin 48 to web 38 near location 40. The adjacent end of pole 16 is coupled by a bolt 50 to the web with the bolt extending through the slot as shown in FIG. 8. A wing nut 52 is threadably coupled to bolt 50 to adjustably secure the end of the pole at any one of a number of fixed positions along the length of slot 44. The arcuate length of the slot is equivalent to an approximately 45° swing of the pole so that the pole can assume the full line position of FIG. 8 or any one of a number of other positions, such as the dashed line position shown in FIG. 8. To position the pole at a particular angle relative to center line 46 of frame 18, wing nut 52 is loosened, permitting movement of bolt 50 to the desired position, then the nut is tightened, thereby releasably securing the pole in a fixed position. In such position, the pole can be manipulated in a manner shown in FIG. 5 so that one of the side edges 31 or 32 can move parallel and over the bottom surface of the pool to clean the bottom of the pool of debris.

In use, pole 16 can be placed in any other suitable operative position with respect to center line 46 of frame 18. Assuming that the pole is parallel with or coincident to central axis 46 of frame 18, the skim net assembly of the present invention can be operated which a shoveling action in the manner shown in FIG. 6. Debris will be directed onto net 14 and then be carried out of the pool to a disposal location. The entire bottom of the pool can be swept this way if desired. As shown in FIG. 7, a typical prior art unit cannot operate in the same manner as the skim net assembly of the present invention because of the blunt end of the frame as shown in FIG. 7.

If the pole is manipulated so that it makes an angle with respect to the center line 46 of frame 18, assembly 10 can then be used in the manner shown in FIG. 5 in which the side edges 31 and 32 can be used in the shoveling action to shovel debris first against the bottom and side wall of the pool and then upwardly out of the pool. This cleaning action is not capable of being achieved with the prior art unit of FIG. 5 because the design of such a prior art unit requires that the corner of the frame only to be in contact with the bottom of the pool so as to cause difficulty in the collection of debris. The present invention presents a side edge to the bottom of the pool for maximum debris collection with incremental angular adjustment.

We claim:

1. A skim net assembly comprising:

a planar frame having a central opening therethrough and provided with a number of outer peripheral frame members including an end member and a pair of side members;

a net across the opening for collecting the debris thereon as the frame is moved in debris-containing water; and a pole and means for pivotally mounting the pole to the frame for rotation about an axis perpendicular to the plane of the frame, said pole extending outwardly from the mounting means for moving the frame in the water to collect the debris therefrom, and said end member and said side members having a blade-like configuration to permit a shoveling action of the frame and thereby allow debris to be readily collected on the net.

2. An assembly as set forth in claim 1, where the means for pivotally mounting the pole on the frame includes means for securing the pole in any one of a number of fixed positions with respect to the frame.

3. An assembly as set forth in claim 2 wherein said frame has a web, there being a pivot pin pivotally mounting the pole near the end thereof on the web, and said means for securing the end of the pole including an adjustable device cooperable with the web.

4. An assembly as set forth in claim 3, wherein the web has a curved slot therein, said securing device including a bolt extending through the slot and having a nut thereon for releasably securing the bolt to the web in a fixed position.

5. An assembly as set forth in claim 1, wherein said pole is pivotally mounted intermediate its ends on said frame for movement into any one of a number of angular positions relative to the frame, and means at the end of the pole for adjustably securing the end of the pole to the frame.

6. An assembly as set forth in claim 5, wherein said frame has a web, there being a pivot pin pivotally coupling the pole near one end of the pole to the web, said securing means including a device coupled to the web at any one of a number of fixed locations thereon.

7. An assembly as set forth in claim 6, wherein the web has a curved slot, said device including a bolt extending through the slot having a nut releasably secured thereto for securing the bolt and thereby the end of the pole in any one of a number of fixed locations on the web.

8. A skim net assembly for cleaning debris from the water in a swimming pool comprising:

a frame having a pair of ends and a pair of sides, one of said ends and each of said sides having a blade-like configuration in cross section;

a net secured at its outer periphery to the ends of sides of the frame with the net being aligned with the central opening of the frame;

a web secured to the frame at the opposite end thereof;

a pole having a pair of opposed ends;

a pivot pin for pivotally coupling the pole on the web at a location on the pole spaced from and in proximity to one end of the pole, said web having a curved slot therein; and bolt means passing through the end of the pole and the slot for releasably securing the pole in any one of a number of fixed angular positions relative to the frame.

* * * * *